US007284757B2

(12) United States Patent
Geissler

(10) Patent No.: US 7,284,757 B2
(45) Date of Patent: Oct. 23, 2007

(54) STRUCTURAL ELEMENTS AND TILE SETS

(75) Inventor: Bernhard Geissler, Laplacestrasse 29, 81679 Munich (DE)

(73) Assignee: Bernhard Geissler, Munich (DE)

( * ) Notice: Subject to any disclaimer, the term of this patent is extended or adjusted under 35 U.S.C. 154(b) by 0 days.

(21) Appl. No.: 11/605,318

(22) Filed: Nov. 29, 2006

(65) Prior Publication Data

US 2007/0069463 A1 Mar. 29, 2007

Related U.S. Application Data

(63) Continuation of application No. 10/275,159, filed as application No. PCT/EP01/05058 on May 4, 2001.

(30) Foreign Application Priority Data

May 4, 2000 (DE) ..... 100 21 607

(51) Int. Cl.
*A63F 9/10* (2006.01)

(52) U.S. Cl. ..... 273/157 R

(58) Field of Classification Search ..... 273/157 R, 273/153 R, 156; D21/480; 52/311.1, 311.2, 52/384, 389, DIG. 10
See application file for complete search history.

(56) References Cited

U.S. PATENT DOCUMENTS 799,681 A * 9/1905 Sloan ..... 52/311.2
909,603 A * 1/1909 Janin ..... 52/311.2
D90,800 S * 10/1933 Cascadden ..... D21/480
D91,130 S * 12/1933 Cascadden ..... D21/480
2,885,207 A * 5/1959 Wormser ..... 273/157 R
3,494,266 A * 2/1970 Baumberger ..... 404/41
3,981,505 A * 9/1976 Odier ..... 273/157 R
4,113,256 A * 9/1978 Hutchings ..... 273/160
4,133,152 A * 1/1979 Penrose ..... 52/105
4,223,890 A * 9/1980 Schoen ..... 273/157 R
4,343,471 A * 8/1982 Calvert ..... 273/157 R
4,561,097 A * 12/1985 Siegel ..... 273/157 R
4,620,998 A * 11/1986 Lalvani ..... 428/33
4,773,649 A * 9/1988 Cheng ..... 273/157 R
4,974,849 A * 12/1990 Kasuya et al. ..... 273/157 R
5,211,692 A * 5/1993 Lalvani ..... 273/157 R (Continued)

FOREIGN PATENT DOCUMENTS

CH 615593 A * 2/1980

OTHER PUBLICATIONS

Shephard, G. C. "Tilings and Patterns", W.H. Freeman and Company, New York, 1987.*

(Continued)

*Primary Examiner*—Steven Wong
(74) *Attorney, Agent, or Firm*—Foley & Lardner LLP

(57) ABSTRACT

The invention relates to sets of structural elements representing equilateral irregular pentagonal structures with angles of 36.degree., 108.degree., 108.degree., 36.degree. and 252.degree., which enable a plurality of patterns that can cover a plane periodically or non-periodically. Modified structural elements in which each side of the equilateral, irregular pentagon is replaced by point-symmetrical lines also cover the plane. Sets of said structural elements can be used for tile applications, tile games such as puzzles, intarsia products, jewelry and the production of fabrics and wallpaper.

10 Claims, 13 Drawing Sheets

U.S. PATENT DOCUMENTS

| | | | | |
|---|---|---|---|---|
| 5,314,183 | A * | 5/1994 | Schoen | 273/157 R |
| 5,575,125 | A * | 11/1996 | Lalvani | 52/311.2 |
| D423,691 | S * | 4/2000 | Fogle | D25/157 |
| 6,309,716 | B1 * | 10/2001 | Fisher et al. | 428/33 |

OTHER PUBLICATIONS

Gardner, Martin, "Mathematical Games", Scientific American, 1977, pp. 110-112, 115-121.*

Grunbaum and Shepard, Tilings and Patterns, W. H. Freeman and Company, New York, 1987, Ch. 1, 3 and 9 (including pp. 15-56, 114-163, 472-518) and p. 539 (72 sheets).*

* cited by examiner

Fig. 10a
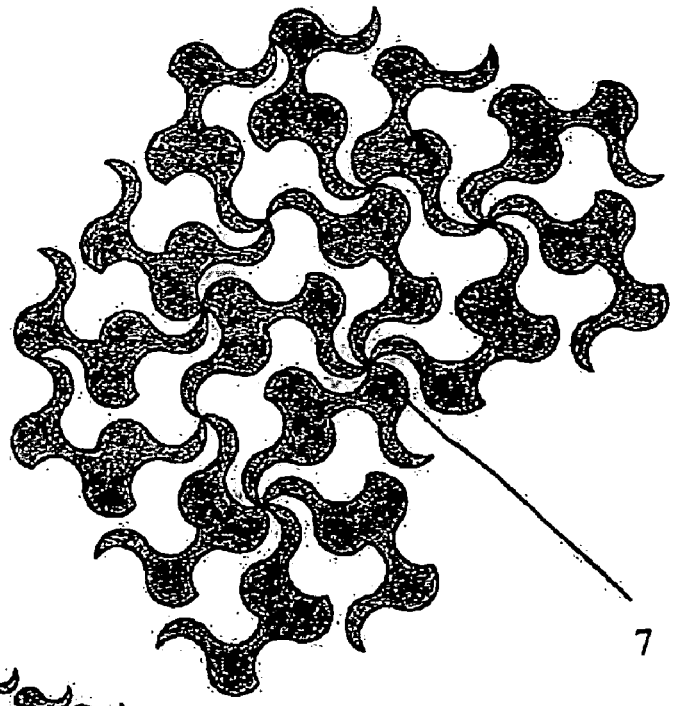
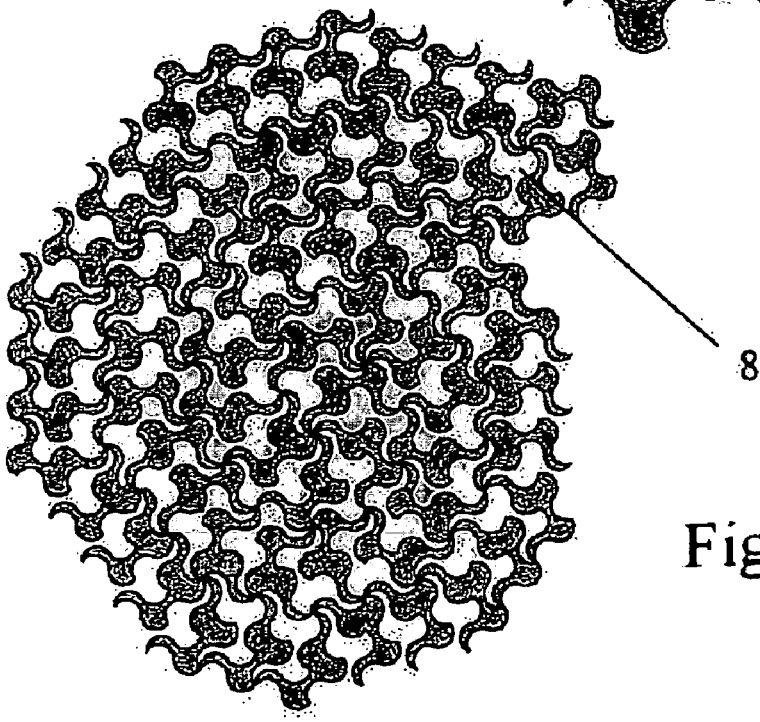
Fig. 10b

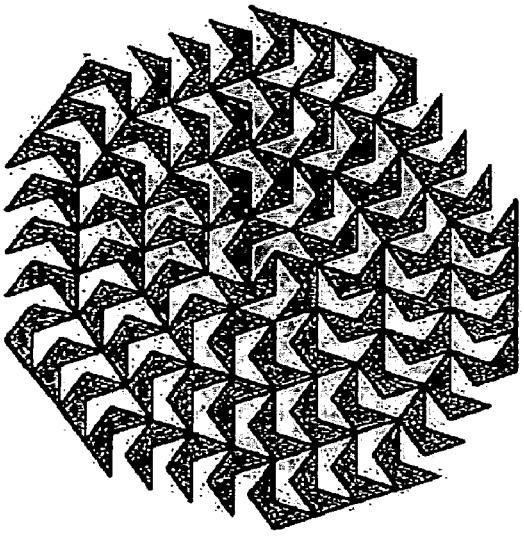
Fig. 11a
Fig. 11b
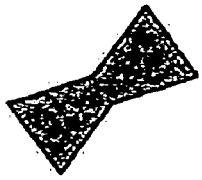
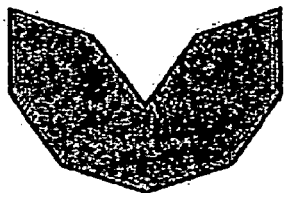
Fig. 11c
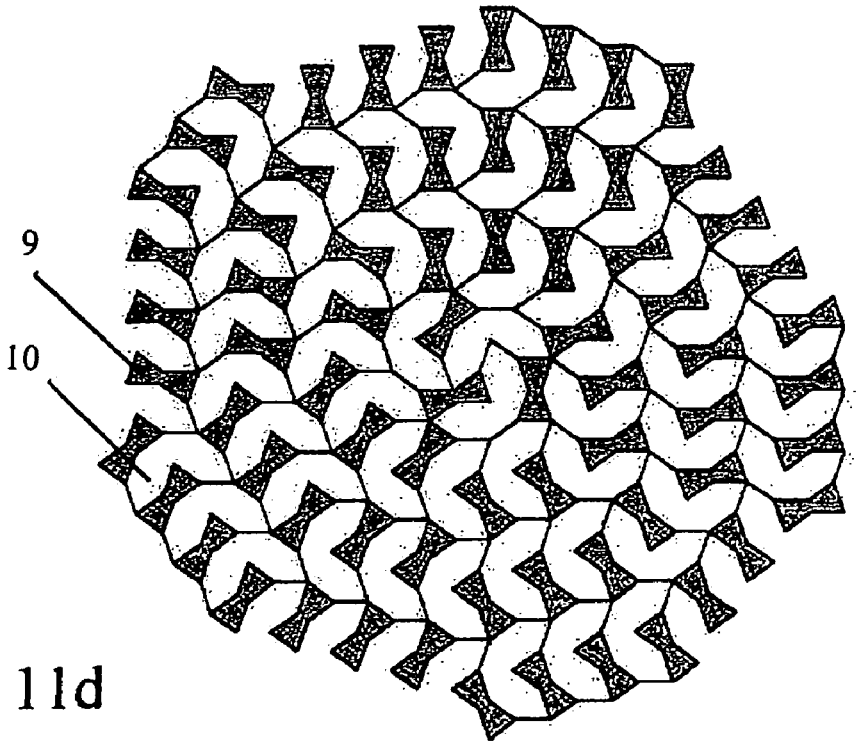
Fig. 11d

STRUCTURAL ELEMENTS AND TILE SETS

CROSS-REFERENCE TO RELATED APPLICATIONS

The present application is a continuation of U.S. application Ser. No. 10/275,159, filed Nov. 4, 2002, which is a national stage application of International Application PCT/EP01/05058, filed May 4, 2001, which claims the right of priority based German Patent Application No. 100 21 607.2, filed May 4, 2000, which are incorporated herein by reference.

BACKGROUND OF THE INVENTION

The invention relates to structural elements as well as sets of structural elements or respectively tiles with geometrically defined circumferences which will be in the following also referred to simply as "tiles", as well as to surface patterns composed of such structural elements or respectively tiles. The invention also relates to applications of these sets of structural elements in tilings, puzzles, placement games, inlays, fabric patterns and jewelry.

Several sets of tiles with geometrically defined circumferences are known. Many of these sets of tiles can tessellate the plane. Some more recent ones have been described in Spektrum der Wissenschaft, January 2000, page 106 *f*. Such tile sets cover the plane either periodically or non-periodically.

Several puzzles use tile sets with geometrically defined structural elements, so the well-known Tangram or the pentagonal puzzle of U.S. Pat. No. 4,343,471. These geometrical tile sets of the puzzles comprise a number of different tiles.

The tile sets which cover the plane are generally limited with respect to the possible structures. Thus tilings from square or hexagonal tiles are only represented in a single periodic structure.

For puzzles but also for tilings or tessellations such as parquet or inlay structures tile sets would be of interest which allow a variety of different structures or patterns in periodic or non-periodical way, but are composed of only one or a very limited number of different types of tiles.

SUMMARY OF THE INVENTION

In accordance with the invention a set of structural elements or tiles with geometrical circumferences is provided as it is defined in the claims. All tiles of these sets, which can of course also be combined with other sets, consist of or derived from equilateral, irregular pentagons with the internal angles 36°, 108°, 108°, 36°, 252°. These equilateral pentagons will be referred to in the following also as "Ipenta(s)". Sets of congruent Ipentas cover the plane in accordance with the invention in many different ways, in particular periodically, non-periodically, symmetrically and non-symmetrically. The tilings can among other possibilities have a decagonal base structure, a parallel gram structure as well as various spiraling structures.

Further objects, features and advantages of the invention will become apparent from the detailed description of preferred embodiments that follows, when considered together with the accompanying figures of drawing.

BRIEF DESCRIPTION OF THE DRAWINGS

The invention will be described in the following in conjunction with the drawing illustrating embodiments.

FIGS. 7*a* to 8*h*-2 show structural elements in accordance with the invention from modified Ipentas, FIGS. 10*a* to *b* shows structural elements in accordance with the invention composed into a spirally tessellation, FIG. 11*a* shows a tessellation from a group of structural elements in accordance with the invention, FIGS. 11*b* to *c* shows two complementary structural elements in accordance with the invention, FIG. 11*d* shows a tessellation of structural elements in accordance with FIGS. 11*b* and 11*c* which is derived from the one in accordance with FIG. 11*a*; and FIG. 12 shows a puzzle made from the structural elements according to one preferred embodiment of the invention.

DETAILED DESCRIPTION OF PREFERRED EMBODIMENTS

Figure 1:
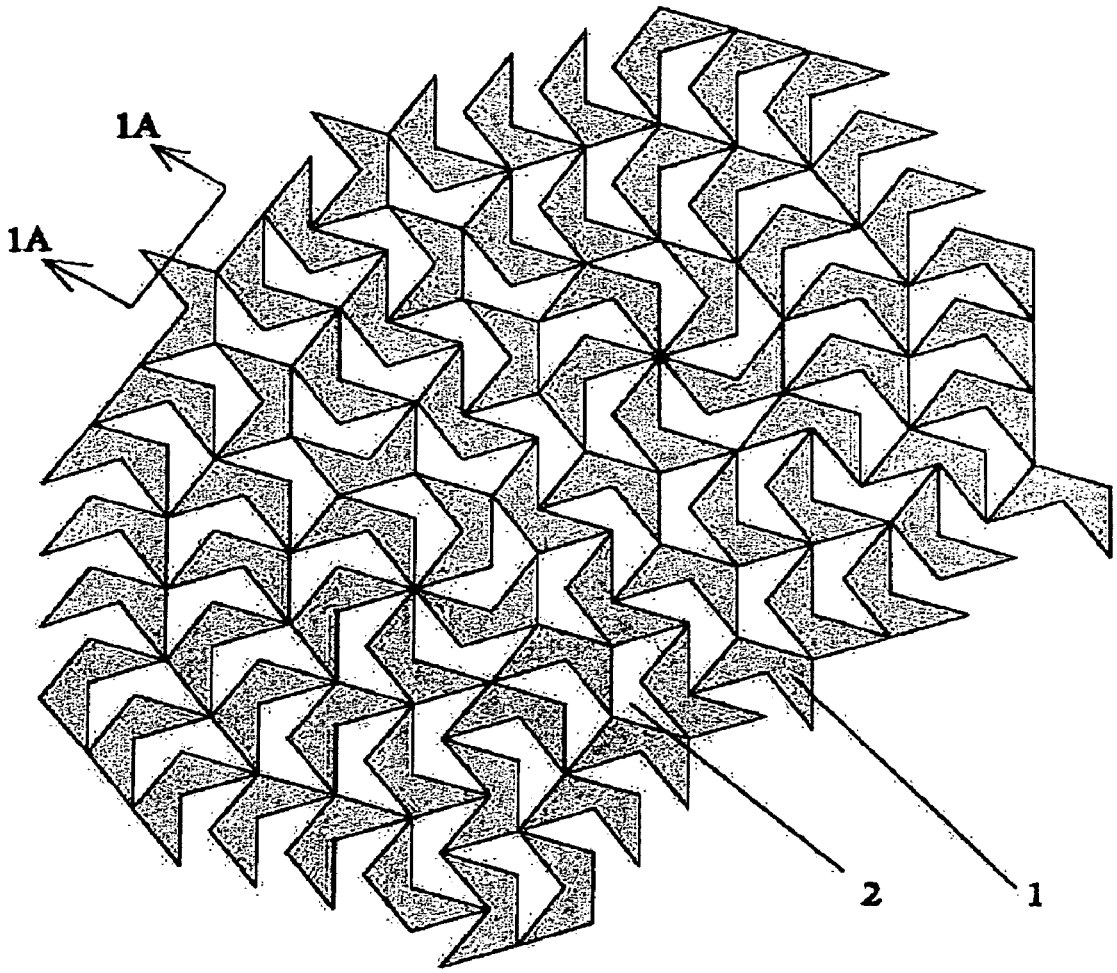
FIGS. 1 to 3 shows different tesellations made from the sets of Ipentas in accordance with the invention.

In U.S. Pat. No. 4,343,471 in FIG. 1. item "7" an Ipenta is shown. This tile is a section of the well-known equilateral pentagonal star cut along an internal diagonal the length of which is equal to the length of the side of a star tip. A reference that this tile can be used to cover the entire plane is absent in U.S. Pat. No. 4,343,471.

In Scientific American 1977, page 110 *ff*. "Mathematical Games" Martin Gardner describes various tilings, among them the famous tiling by Roger Penrose. These tiles are not equilateral.

In all plane covering tilings using the groups of Ipentas or tiles derived from such Ipentas as described in the following, always an even number of four to ten of such Ipentas meet each other in each interstices or crossing point. Thus, each pattern can be represented by tiles of two different colors in such a way, that never two tiles of the same color will contact each other along a side of the pentagon. Thus a quasi checkerboard structure results.

The set or group of structural elements in accordance with the invention can in particular also contain modifications of the Ipentas as they will be described in more detail in the following.

The sets of structural elements in accordance with the invention can preferably be used in the following applications, which themselves represent embodiments or respectively further examples of the invention.

The sets of structural elements can be tile sets for the inside or the outside. With these sets floor areas, places and walls can be covered. Insofar these tiles can be made from traditional materials such as ceramic, marble, precious stones, plastic, metals or wood. The corners can be rounded, preferably with equal radius of curvature in the corners or with curvature sections of the smaller corner being repeated in the larger corners in a convex or respectively concave manner three times in a congruent fashion. Thereby the roundings in all patterns fit smoothly together.

The structural elements can be used for placement games, in particular for puzzles. These puzzles can be provided in a standard fashion with pictures which are to be placed. These placements or respectively puzzles in accordance with the invention preferably have a solid and set frame area, or they can be cut straight in order to provide e.g. a rectangular edge, whereby however edge pieces are generated which differ from the congruent puzzle pieces. In the embodiment of the placement game which has a solid fixed frame with a non-smooth internal edge the structure elements can be employed in a game in which two or more players alternate in placing the structural elements and e.g. the player wins who places the last structural element. Since the structural elements can be placed in the range inside of the edge not only in a completely space filling way, it is not a priori defined how many of such structural elements can be placed. This depends rather exclusively from how the structural elements are being placed. But alternating placement of a structural element or also of a plurality of those (e.g. determined by the number of a dice) interesting game variations can result. The placement game in accordance with the invention preferably have a larger number of structural elements, in particular more than nine and the structural elements consist all preferably in one or two sets of congruent structural elements as well as optionally in the above mentioned frame area.

In many of the known puzzles none of the elements geometrically fit onto the other, unless also the picture area fits together. In accordance with the puzzle of the invention all pieces match with all sides of the other pieces without the requirement that the picture areas also fit. This increases the difficulty of the puzzle.

In a particular embodiment of the puzzles or respectively placement games of the invention, the sides of the Ipentas or respectively the structures resulting from these Ipentas have been replaced by line sections which upon placement of the puzzle pieces will result in their hookup. For the Ipentas this can occur by replacing each of the five sides by one bulging line which bulges to the left and centrally symmetrically thereto to the right, whereby back cuts or respectively hookups become possible.

In accordance with the invention, the sets of the structural elements can be made from wood, stone, ceramic, glass, plastic, metal or precious stones and be formed into inlays. These structures can, in spite of their geometrical rigidity, formed into a variety of pictures by multiple kinds of positioning of the structural elements.

Most arrangements of the Ipentas can be described by a non-intersecting line sequence. When this line sequence is rounded out, the contact areas disappear and a continuous, generally singly connecting area results which can be for instance cut from veneer, in particular by means of a laser, and can be placed into a plate or section with the corresponding cutout. Such items, in particular on surfaces of furniture, are a further embodiment of the invention.

The set of structural elements can be composed into fabric patterns or respectively wallpaper patterns or similar items, in which the entire area is completely or substantially completely covered by Ipentas or respectively modified Ipentas, wherein the circumference however due to a randomization or respectively accidental distribution do not repeat. In this case, the preferred embodiment is made from a periodically repeating hexagonal subdivision of eight Ipentas, in which the Ipentas, however, can be statistically distributed differently from sub area to sub area, so that in spite of the periodicity of the edge of the sub group a statistically non-periodic arrangement of Ipentas results. For most observers the hexagonal structure of the sub areas thereby disappears.

A further embodiment of the invention are new structural elements or respectively tiles which are derived from the Ipentas. A first group of these structural elements results from the Ipentas by replacing each side of the Ipentas by a line track, a vector sequence or a curved section (in the following "curved section"), in which the distance between the end points is the same and for which at least one of these is non-straight. Preferably all five curved sections are equal, resulting in either one or two new modified Ipentas, which have five "main corners" which spread or define an Ipenta. If the curved sections are centrally symmetrical, then only one new structural element results. Otherwise two of these arise, depending upon whether the replacement of the five sides of the Ipenta by curve sections is done clockwise or counterclockwise.

Among the new structural elements those are particularly preferred, in which the curved sections have a centrally symmetrical S- or respectively Z-shape. Among these again those are particularly attractive for applications such as puzzles or other placement games, in which the curve sections cause a hooking or interlocking of the juxtaposed structural elements. The latter can be achieved by providing that at least two partial sections of the curve sections form an angle of more than 180° with each other. Preferably the curved sections neither intersect with themselves nor do they intersect the curved sections of the other sides of the Ipentas.

If the curved sections consist of two line elements forming an angle of 144° the two inventive structural elements with ten (FIG. 11*c*) or respectively six (FIG. 11*b*) corners arise. For the structural elements with six corners one simply leaves out the resulting double lines running back and forth, since these cover zero area. In a more general sense the following can be stated: If the line segment consists of a number of n>2 sections and the angle between the first and the last section is 144°, then the tessellation of Ipentas results in a tessellation made from two groups of congruent tiles having a different circumference length of the two tiles. The difference of the circumference length is four times the overlap of the first and last section of the line sections. Again one leaves out the overlapping line sections of the smaller structural element.

In the case of the structural elements which have five identical but not centrally symmetrical curved sections, two different structural elements result (e.g. the just described structural elements with ten or respectively six corners), wherein each tiling or complete covering of the plane or respectively with a plane section with these structural elements comprises approximately the same number of the two different structural elements.

The invention further provides new structural elements or respectively tiles which are also derived from Ipentas and have a circumference which results from placing at least two Ipentas along one or two sides juxtaposed with each other. Preferred are the structural elements from two so juxtaposidly positioned Ipentas, whereby seven different (not counting mirror reversing) structural elements result, six of those having eight and one of those having six sides of equal length. Three of the structural elements can tile the plane periodically or non-periodically, wherein only the line symmetrical structural element allows the tiling with this single structural element. The others form structural elements which can tile the claim only together with the structural element which is mirror symmetrical to them. These three structural elements with eight and one with six sides are the preferred ones in this group. Also with these structural elements each side can be replaced by a curved section.

Thereby again one or two groups of structural elements result which can in the case of a tessellation or tiling e.g. be interlocked with each other.

Figure 1A:
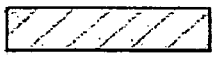

In FIG. 1 and FIG. 1A a non-periodic tessellation of Ipentas as well as a cross-section along line A-A is shown. These Ipentas 1 and 2 all congruent and have one or two colors. Two "circles" (decagons) from ten Ipentas are shown in FIG. 1. The possibility to continue this structure into infinity can be recognized.

Figure 2:
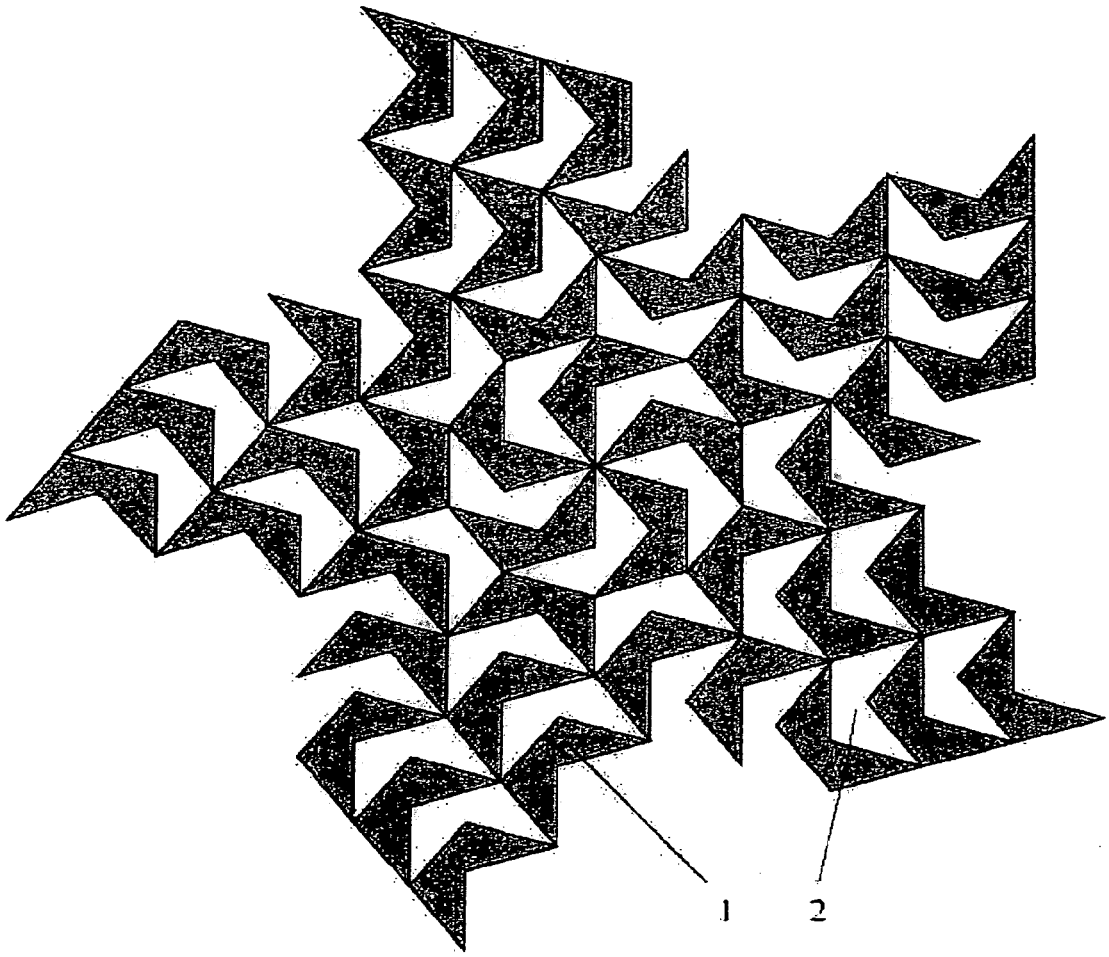

In FIG. 2 a non-periodic, centrally symmetrical tessellation from Ipentas 1 and 2 is shown. There, too, the neighboring structural elements switch color.

Figure 3:
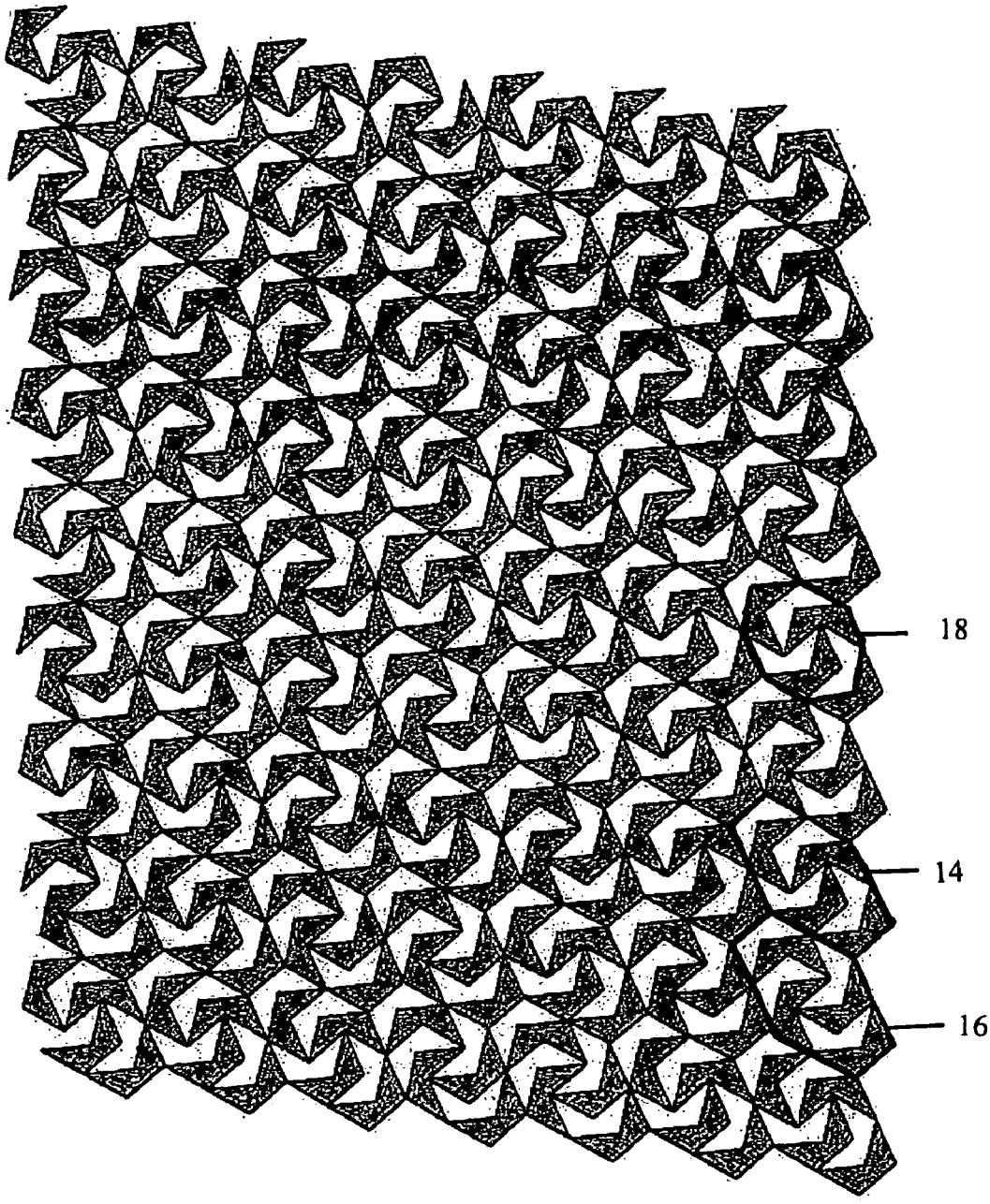

In FIG. 3 a non-periodic tessellation from Ipentas is shown. Each time eight of these Ipentas (four light ones and four dark ones) form a hexagon 14, 16. The circumference of these hexagons tile the plane periodically. The Ipentas themselves however tile the plane non-periodically, wherein the two possible arrangements of the eight pentagons in the hexagon (Compare 14 and 16) is determined by an arbitrary or statistical distribution. However, also an algorithm can be used for this. As also can be seen FIG. 3, six of the eight Ipentas forming each hexagon themselves form another polygon, in this case an octagon 18. It is these six, centrally located Ipentas in the set of eight Ipentas making up the hexagons that give rise to the two possible arrangements noted above, as is readily seen from FIG. 3.

In FIGS. 7*a* to 7*h* structural elements are shown which have been derived from Ipentas. For these the sides of the Ipentas have been replaced by centrally symmetrical line sequences appearing edgy or rounded. This results in congruent structural elements for the tessellations. Indentations which result in a secure connection or hookup of the structural elements are shown in some of FIGS. 7*a* to *h*.

In FIGS. 8*a*-1,2 to 8*h*-1,2 respectively two structural elements or respectively tiles are shown, which follow from the Ipentas as follows: First each line of the Ipentas is replaced by two lines of equal length having an angle of 144° between them. Thereby, as described above, two structural elements 9 and 10 as they are shown in FIGS. 11*b* and *c* in a tessellation in FIG. 11*d*, result. If one now replaces each of these ten or respectively six sides of the structural elements by the corresponding line sequences or line shapes, as this has been also done with the Ipentas themselves in the corresponding representations of FIGS. 7*a*-*h*, then the shown modified structural elements result. The structural elements 8*a*-1 and 8*a*-2 (and correspondingly for 8*b*-*h*) tile together the plane, partially with interlocking or hookup.

In FIGS. 9*a*-*g* seven structural elements are shown which result from juxtaposing two Ipentas along one side or two sides. In FIG. 9*h* it is shown how these seven structural elements can be put into a shape of minimal circumference. From these structural elements in accordance with the invention three structural elements are particular preferred, because these either alone or together with others or respectively with those appearing mirror symmetrical to them the plane can be tiled periodically and non-periodically. These are the structural elements in accordance with FIGS. 9*a*, 9*f*, 9*g*. Thereby these, too, can be used for the above mentioned applications. In the case of the structural element in accordance with FIG. 9*g* this is an equilateral irregular hexagon which is derived from two Ipentas, which are juxtaposed along two lines. In the case of the structural elements of FIGS. 9*a* and 9*f*, these are also equilateral, irregular octagonal structural elements which are obtained by juxtaposition of two Ipentas along one line.

Figure 4:
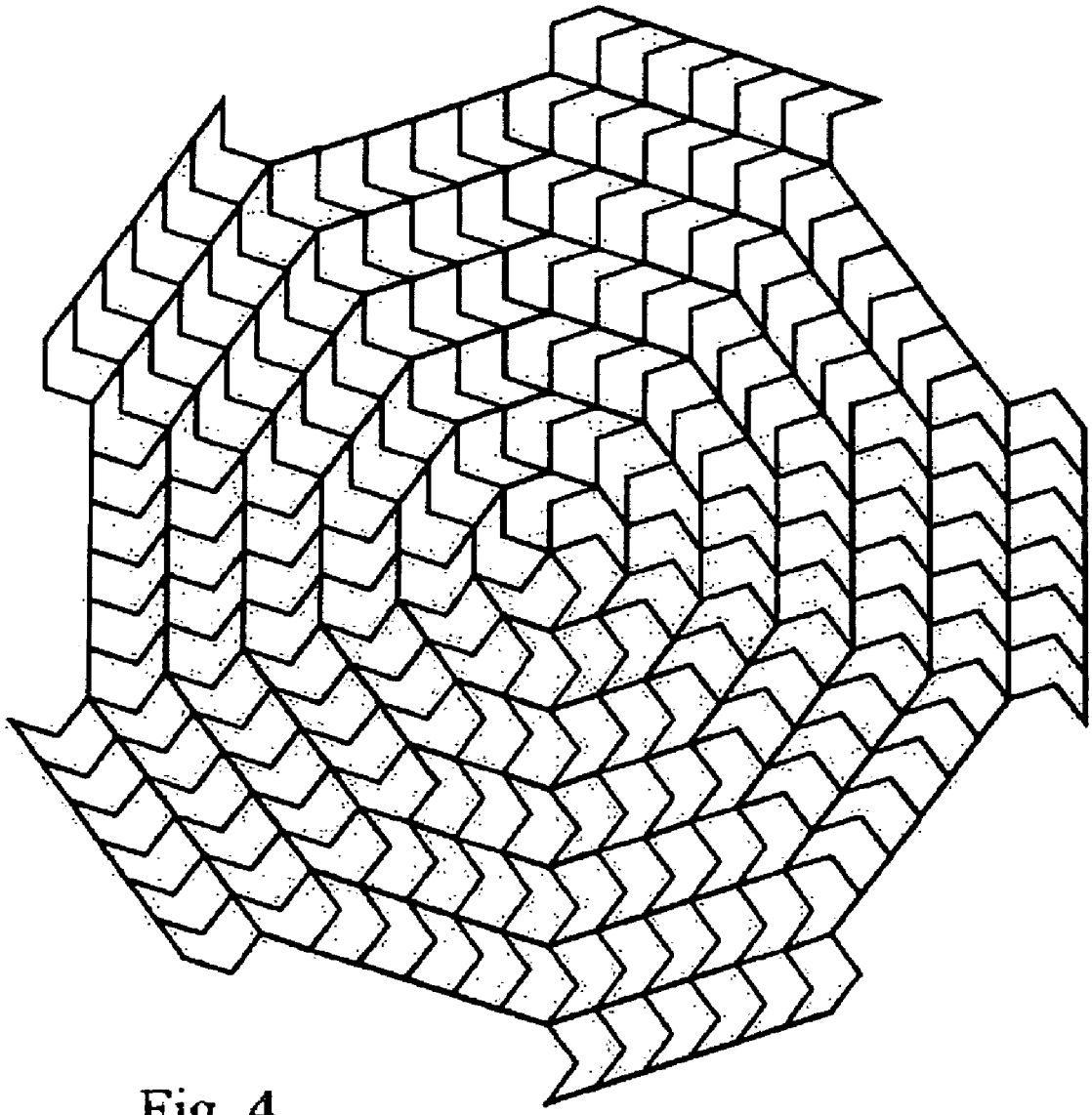
FIGS. 4 to 6 show tessellations by sets of modified Ipentas.
Figure 5:
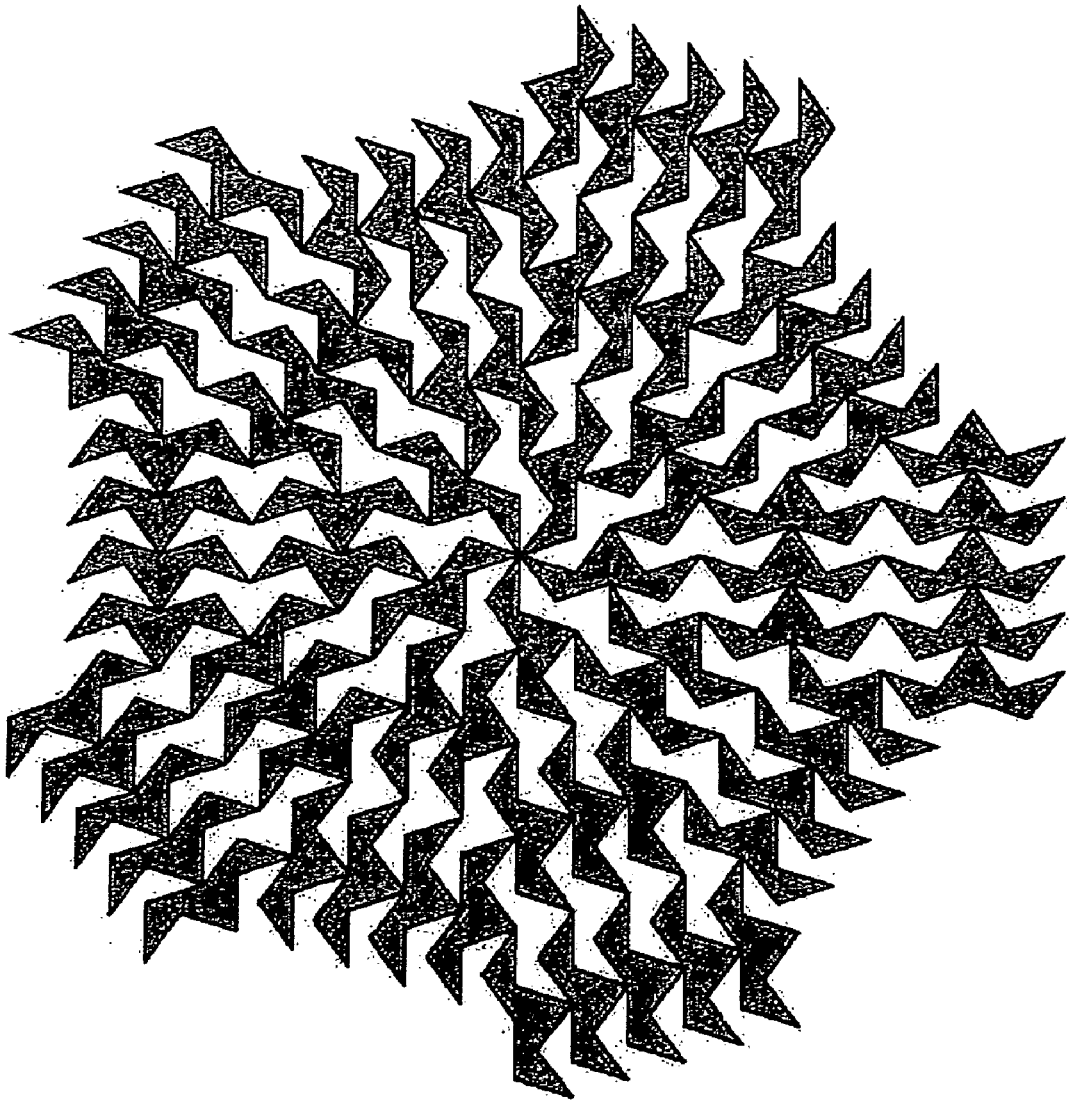
Figure 6:
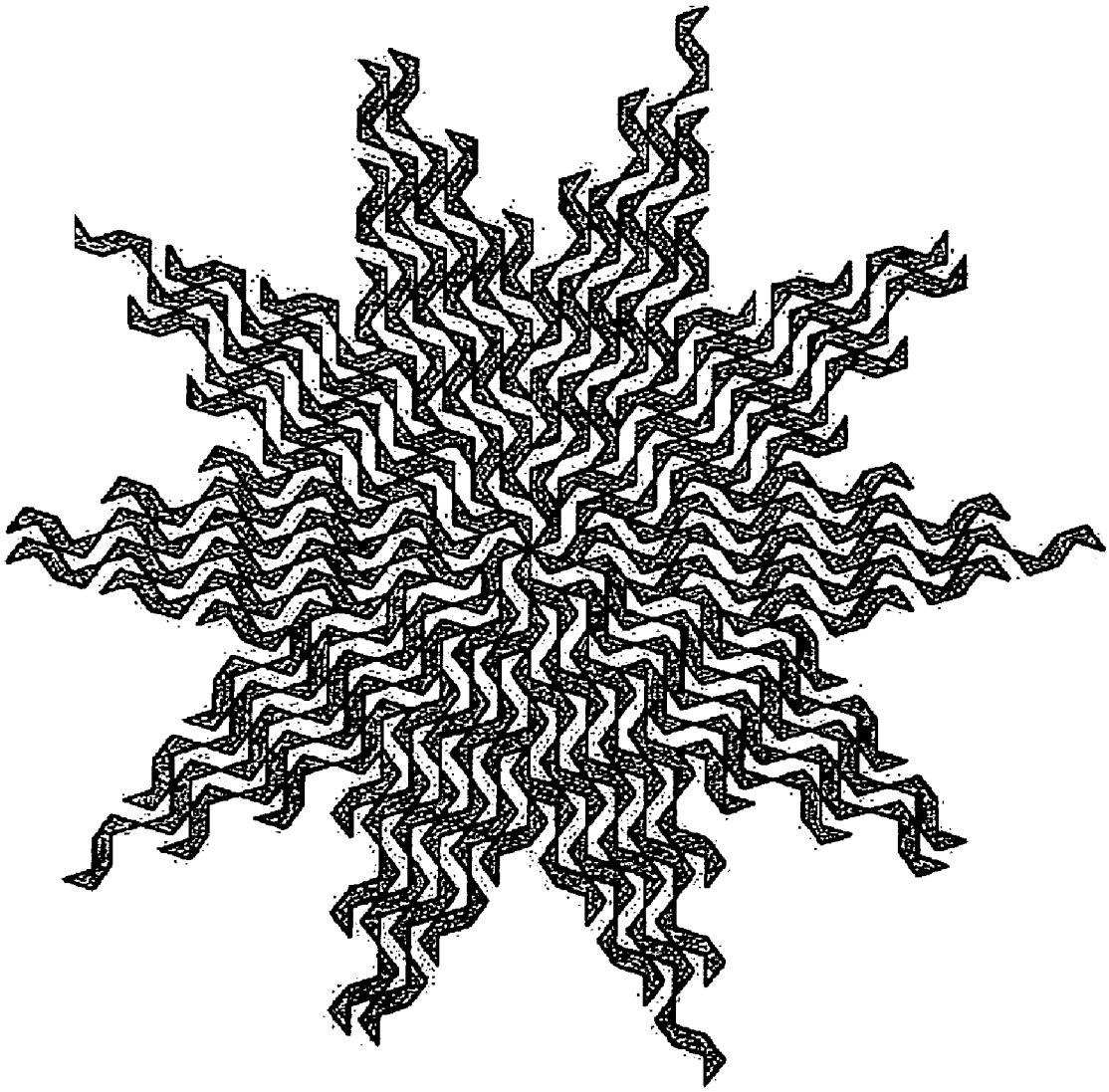
Figure 7A:
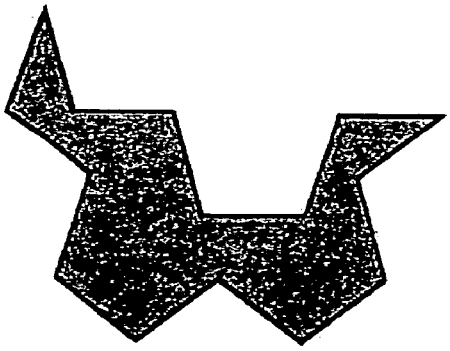
Figure 7B:
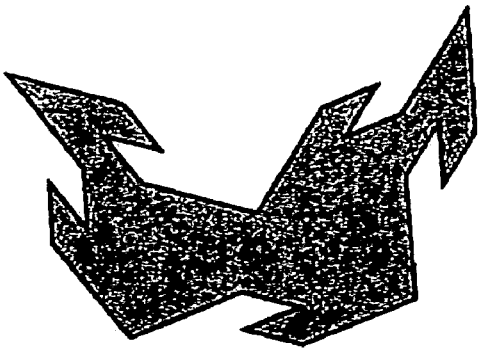
Figures 1, 8A:
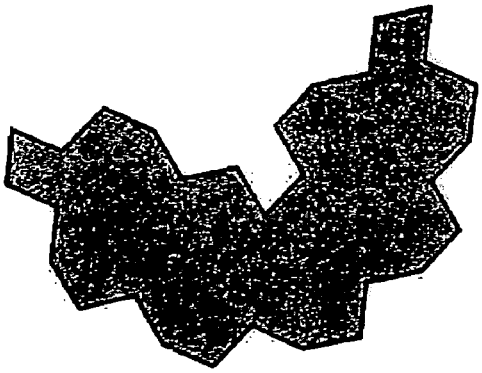
Figures 1, 8B:
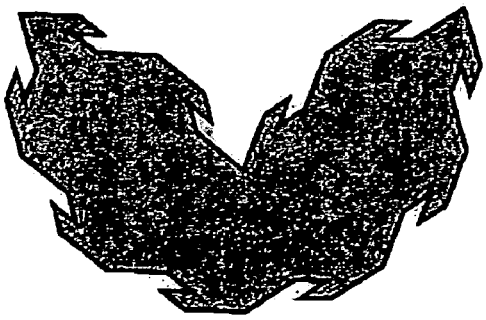
Figures 2, 8A:
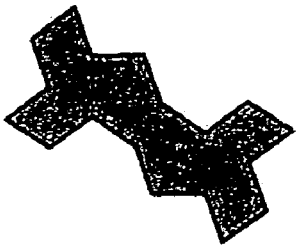
Figures 2, 8B:
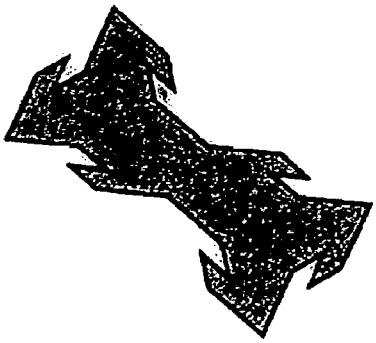
Figure 7C:
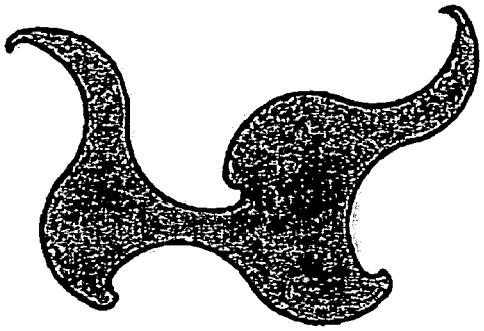
Figure 7D:
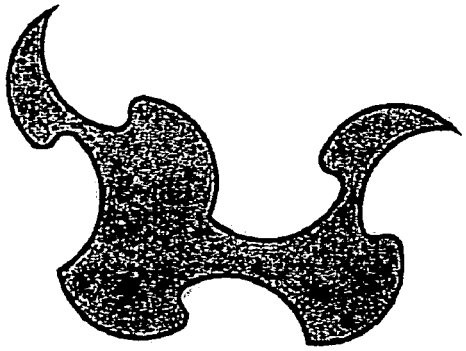
Figures 1, 8C:
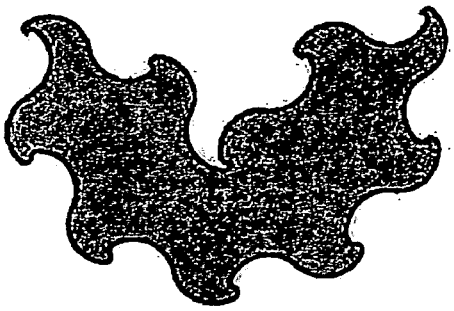
Figures 1, 8D:
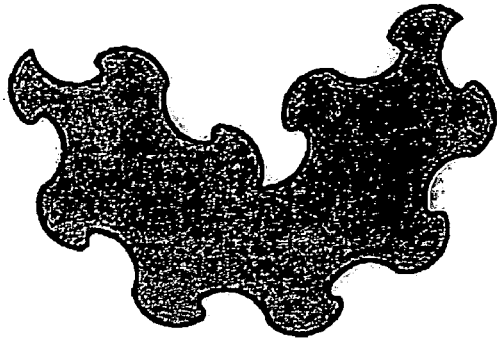
Figures 2, 8C:
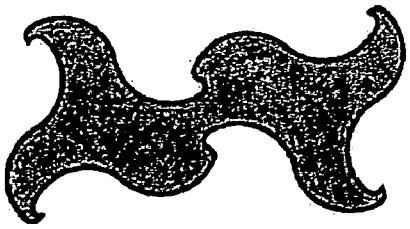
Figures 2, 8D:
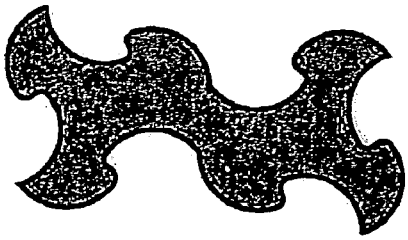
Figure 7E:
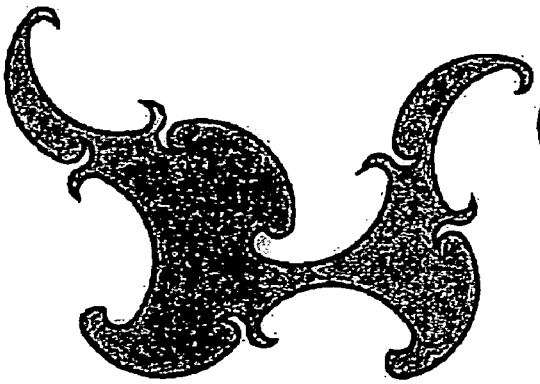
Figure 7F:
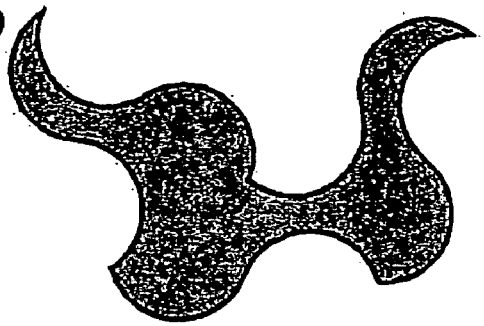
Figures 1, 8E:
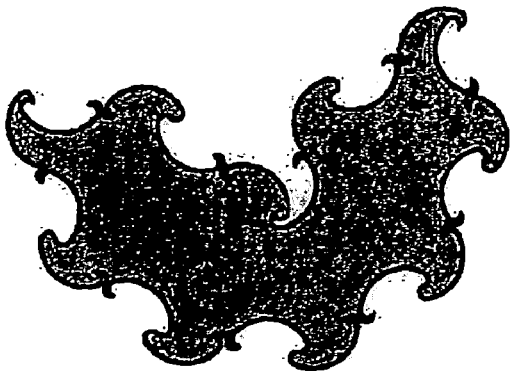
Figures 1, 8F:
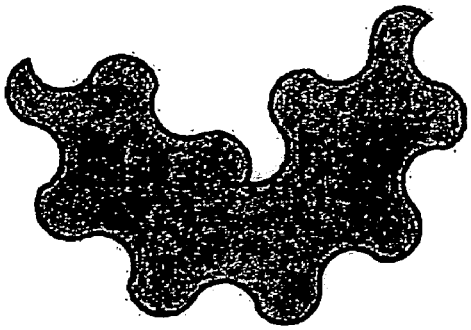
Figures 2, 8E:
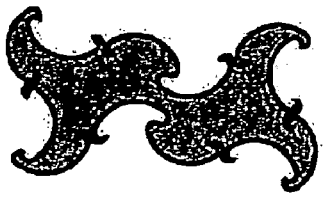
Figures 2, 8F:
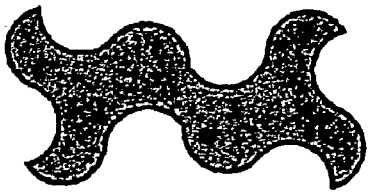
Figure 7G:
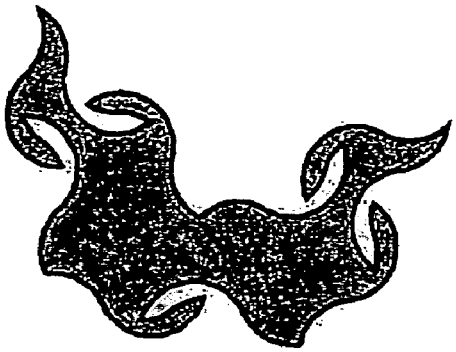
Figure 7H:
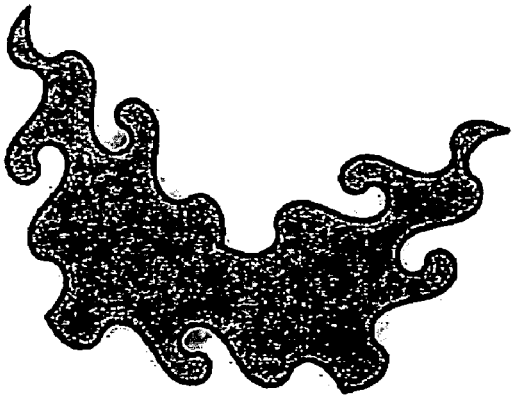
Figures 1, 8G:
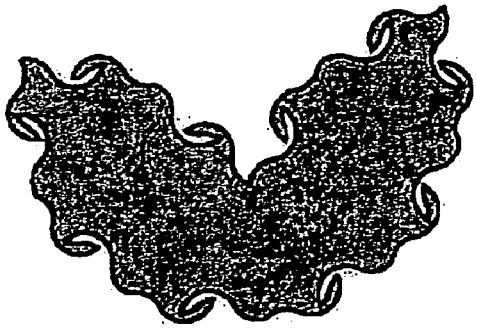
Figures 1, 8H:
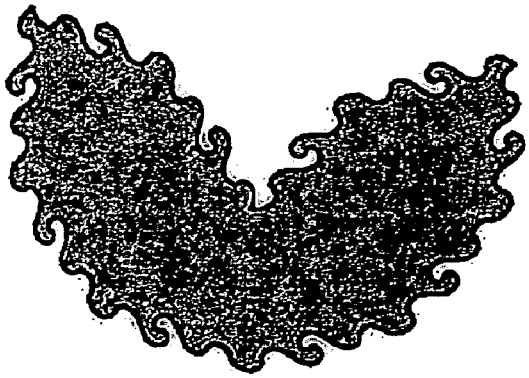
Figures 2, 8G:
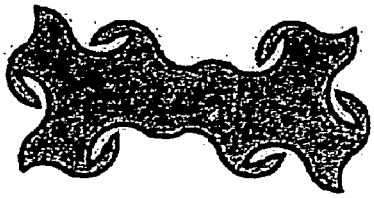
Figures 2, 8H:
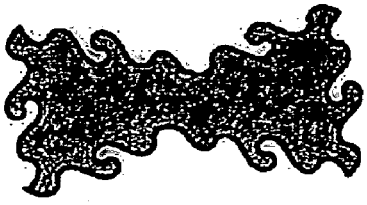
Figure 9A:
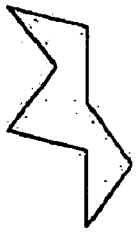
FIGS. 9*a* to *g* show structural elements in accordance with the invention which are composed of two Ipentas.
Figure 9B:
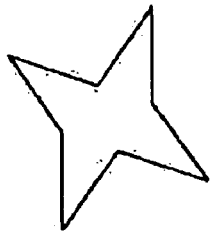
Figure 9C:
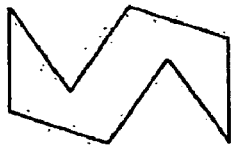
Figure 9D:
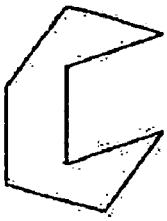
Figure 9E:
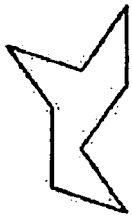
Figure 9F:
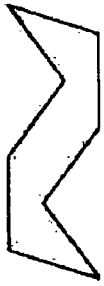
Figure 9G:
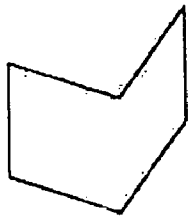
Figure 9H:
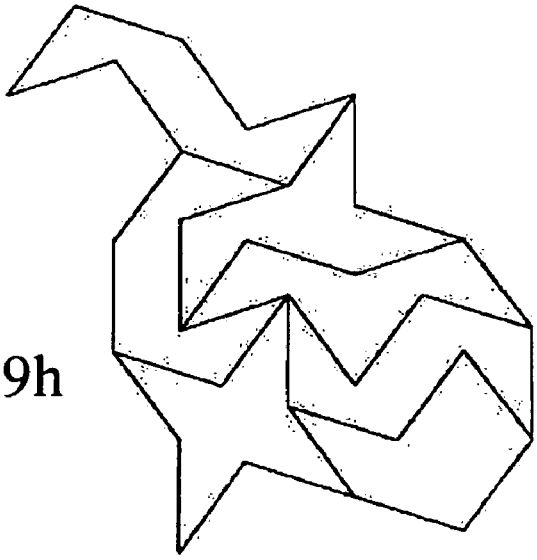
FIG. 9*h* shows the structural elements of FIGS. 9*a*-*g* put together.

Non-periodical tessellations from the structural elements in accordance with FIGS. 9*a*, 9*f*, 9*g* are shown in FIGS. 5, 6 and 4. Only the structural element in accordance with FIG. 9*a* tiles or tessillates the plane by itself, see FIG. 5. In the case of structural elements in accordance with FIGS. 9*f* and 9*g* one needs for this purpose in addition the mirror symmetrical structural elements as shown in FIG. 6 by the gaps between the structural elements (or by white elements).

In FIGS. 10*a* and *b* two tessellations with modified Ipentas 7 and 8 are shown which have a spiraling structure, and wherein FIG. 10*b* encompasses the arrangement of FIG. 10*a* and shows the growing spiral. The individual structural elements 7 and 8 correspond to the structural element shown in FIG. 7*d*.

In FIGS. 11*a*-*d* it is shown how new structural elements 9 and 10 result from the Ipentas. The original tessellation from pure Ipentas is shown in FIG. 11*a*. If one replaces in this starting tessellation each side by a line sequence of two lines forming an angle of 144°, then the tessellation in accordance with FIG. 11*d* results, wherein the double lines, as described, have been omitted. In this way two sets of tiles which are individually shown in FIG. 11*b* and FIG. 11*c* result. The first set consists of equilateral decagonal structure elements, while the second set consists of equilateral hexagonal structural elements. The decagonal structural element is equilateral and has the angles 288°, 144°, 72°, 144°, 144°, 144°, 144°, 144°, 72°, 144°. The hexagonal structural element has the same side length as the decagonal structural element and the angles are 72°, 72°, 216°, 72°, 72°, 216°.

Placement games based on the above tessellation preferably in addition have a surrounding edge 20 (FIG. 12) which does not touch the tessellation, e.g. a rectangular edge, which confines the placement game, which can for instance be cut from cardboard, plastic material or wood, and thus defines a closed edge area 22 which surrounds the internal area. The confines the placement game, which can for instance be cut from cardboard, plastic material or wood, and thus defines a closed edge area 22 which surrounds the internal area. The internal area is filled by the set of structural elements 24 in accordance with the invention or respectively by the two represented sets. Also placement games can be formed in such a way that one side can be used as a puzzle with picture 26 (FIG. 12) and the other side with no picture and with the structural elements of the same color or with the structural elements of different colors, e.g. up to six colors, can be formed. With this other side or the so formed single sided placement games it is possible to play in a multitude of ways games, in which one defines the winner as the one who places the last element or one can use a dice to determine how many elements a player has to place and the winner or loser is defined by the number of placed structural elements or the number of no longer placable structure elements. One can also establish game rules in accordance with which it is the goal to connect with one contiguous chain of ones own elements to edges, or to surround areas defined by one color and thereby make the surrounded areas as large as possible, wherein their six is defined by the number of structural elements playable side by side into the surrounded area. Thereby games result which are related to NIM-games or to the game of GO, which however in addition addresses the understanding of the player for the geometry of the structural elements and thus has a further educating effect.

In a further embodiment the placement game in accordance with the invention, which is particularly useful on trips, the structural elements are limited by magnetic forces in their movement. Also the structural elements with back cuts which define the juxtaposition and ensure against shifts are useful for this purpose.

What is claimed is:

1. A puzzle comprising:

a closed edge area comprising a solid, fixed frame encompassing a placement area, a group of a plurality of congruent identically shaped puzzle pieces which, when properly placed, can completely fill said placement area, wherein the puzzle pieces comprise indicia on at least one side which, when the puzzle pieces are properly fitted together, form a predetermined image, each puzzle piece having a circumference consisting of five lines that connect corner points defining an irregular equilateral pentagon with angles of 36°, 108°, 108°, 36°, 252°, each line being a centrally symmetrical non-straight line with respect to straight lines extending between respective corner points and comprising a shape that permits the puzzle piece to tile a plane, wherein the five lines do not intersect or touch each other except in the corners of the irregular equilateral pentagon, wherein each of said centrally symmetrical non-straight lines forms a back cut to allow the puzzle pieces to hook to each other for a secure connection; and wherein said placement area and said plurality of puzzle pieces comprise six of said irregular equilateral pentagon-shaped puzzle pieces arranged so that their external corner points define an octagon.

2. A puzzle, comprising:

a closed edge area comprising a solid, fixed frame encompassing a placement area, a group of a plurality of congruent identically shaped puzzle pieces which, when properly placed, can completely fill said placement area, wherein the puzzle pieces comprise indicia on at least one side which, when the puzzle pieces are properly fitted together, form a predetermined image, each puzzle piece having a circumference consisting of five lines that connect corner points defining an irregular equilateral pentagon with angles of 36°, 108°, 108°, 36°, 252°, each line being a centrally symmetrical non-straight line with respect to straight lines extending between respective corner points and comprising a shape that permits the puzzle piece to tile a plane, wherein the five lines do not intersect or touch each other except in the corners of the irregular equilateral pentagon, wherein each of said centrally symmetrical non-straight lines forms a back cut to allow the puzzle pieces to hook to each other for a secure connection; and wherein said placement area and said plurality of puzzle pieces comprise eight of said irregular equilateral pentagon-shaped puzzle pieces arranged so that their external corner points define a hexagon.

3. A puzzle according to claim 1, wherein said group of puzzle pieces is capable of tessellating the plane within the placement area.

4. A puzzle according to claim 3, wherein the closed edge area defines a contiguous, completely unoccupied placement area.

5. A puzzle according to claim 3, wherein the placement area can be filled exclusively with said puzzle pieces.

6. A puzzle according to claim 1, wherein the centrally symmetrical non-straight lines comprise curved lines.

7. A puzzle according to claim 1, wherein the group of puzzle pieces is capable of tessellating the plane of the placement area if placed properly in the placement area and is further capable of failing to tessellate the placement area if not properly placed in the placement area, notwithstanding proper interlocking with respective other puzzle pieces and connecting with the closed edge area.

8. A puzzle, comprising:

a closed edge area comprising a solid, fixed frame encompassing a placement area, a group of a plurality of congruent identically shaped puzzle pieces which, when properly placed, can completely fill said placement area, wherein the puzzle pieces comprise indicia on at least one side which, when the puzzle pieces are properly fitted together, form a predetermined image, each puzzle piece having a circumference consisting of five lines that connect corner points defining an irregular equilateral pentagon with angles of 36°, 108°, 108°, 36°, 252°, each line being a centrally symmetrical non-straight line with respect to straight lines extending between respective corner points and comprising a shape that permits the puzzle piece to tile a plane, wherein the five lines do not intersect or touch each other except in the corners of the irregular equilateral pentagon, wherein each of said centrally symmetrical non-straight lines forms a back cut to allow the puzzle pieces to hook to each other for a secure connection; and wherein said placement area and said plurality of puzzle pieces comprise at least nine of said irregular equilateral pentagon-shaped puzzle pieces, with six of said nine irregular equilateral pentagon-shaped puzzle pieces arranged so that their external corner points define an octagon.

9. A puzzle according to claim 1, wherein the puzzle pieces are of at least one solid color on their side obverse to said indicia.

10. A puzzle according to claim 9, wherein a first subset of puzzle pieces has a first solid color on their respective sides obverse to said indicia, and a second subset of puzzle pieces has a second, different solid color on their respective sides obverse to said indicia.

* * * * *